US009953585B2

(12) United States Patent
Abe et al.

(10) Patent No.: US 9,953,585 B2
(45) Date of Patent: Apr. 24, 2018

(54) DISPLAY DEVICE AND DISPLAY CORRECTION METHOD

(75) Inventors: Masatoshi Abe, Tokyo (JP); Katsuyuki Matsui, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 87 days.

(21) Appl. No.: 14/394,730

(22) PCT Filed: Apr. 18, 2012

(86) PCT No.: PCT/JP2012/060506

§ 371 (c)(1),
(2), (4) Date: Dec. 3, 2014

(87) PCT Pub. No.: WO2013/157104

PCT Pub. Date: Oct. 24, 2013

(65) Prior Publication Data

US 2015/0091951 A1 Apr. 2, 2015

(51) Int. Cl.
*G09G 5/10* (2006.01)
*G09G 3/36* (2006.01)
(Continued)

(52) U.S. Cl.
CPC ..... *G09G 3/3406* (2013.01); *G09G 3/006* (2013.01); *G09G 3/20* (2013.01); *G09G 3/3413* (2013.01);
(Continued)

(58) Field of Classification Search
CPC ..... G09G 3/3614; G09G 3/3648; G09G 2320/0238
See application file for complete search history.

(56) References Cited

U.S. PATENT DOCUMENTS 6,611,249 B1 * 8/2003 Evanicky ..... G01J 3/02 345/102
2003/0231161 A1 * 12/2003 Yamaguchi ..... G09G 3/3406 345/102
(Continued)

FOREIGN PATENT DOCUMENTS

JP 11-069370 A 3/1999
JP 2002-162937 A 6/2002
(Continued)

OTHER PUBLICATIONS

International Search Report (ISR) (PCT Form PCT/ISA/210), in PCT/JP2012/060506, dated Jul. 10, 2012.
(Continued)

*Primary Examiner* — Nan-Ying Yang
(74) *Attorney, Agent, or Firm* — McGinn L.P. Law Group, PLLC

(57) ABSTRACT

A display device includes a display which is configured to display an image; a backlight which is turned on in the rear face of the display; a storage unit which is configured to store luminance characteristics at the center of the display; an optical sensor which is configured to measure luminance in the periphery of the display; and a signal processing unit which is configured to correct the measured value measured with the optical sensor in the periphery of the display based on luminance characteristics stored in the storage unit, thus controlling the luminance of the display based on the corrected measured value.

9 Claims, 7 Drawing Sheets

(51) Int. Cl.

| | |
|---|---|
| ***G06F 3/038*** | (2013.01) |
| ***G09G 5/00*** | (2006.01) |
| ***G09G 3/34*** | (2006.01) |
| ***G09G 3/20*** | (2006.01) |
| ***G09G 3/00*** | (2006.01) |

(52) U.S. Cl.
CPC ..... *G09G 3/36* (2013.01); *G09G 2320/0233* (2013.01); *G09G 2320/0276* (2013.01); *G09G 2320/066* (2013.01); *G09G 2320/0626* (2013.01); *G09G 2320/0673* (2013.01); *G09G 2330/12* (2013.01); *G09G 2360/145* (2013.01); *G09G 2380/08* (2013.01)

(56) References Cited

U.S. PATENT DOCUMENTS

2005/0094110 A1* 5/2005 Nakamura ..... H04N 5/74 353/85
2006/0061593 A1* 3/2006 Miura ..... G09G 3/22 345/612
2012/0120128 A1* 5/2012 Oh ..... H04N 13/0438 345/691

FOREIGN PATENT DOCUMENTS

| | | | |
|---|---|---|---|
| JP | 2005-208548 | A | 8/2005 |
| JP | 2005-283816 | A | 10/2005 |
| JP | 2005-338451 | A | 12/2005 |
| JP | 2007-034209 | A | 2/2007 |
| JP | 2011-048100 | A | 3/2011 |

OTHER PUBLICATIONS

Japanese Office Action dated Jul. 14, 2015 in Japanese Application No. 2014-511029 with an English translation thereof.
MD Kenkyukai, "JPC official Color Management Practical Rule Visual Book 2002-2003", Works Corporation Co., Ltd., Sep. 30, 2002, p. 88.
Japanese Notice of Allowance in corresponding application No. JP 2014-511029 dated Mar. 1, 2016 and English Translation thereof.

* cited by examiner

DISPLAY DEVICE AND DISPLAY CORRECTION METHOD

TECHNICAL FIELD

The present invention relates to a display device and a display correction method.

BACKGROUND ART

It is important for medical display devices to exhibit gamma characteristics according to DICOM (Digital Imaging and Communication in Medicine) curves; hence, medical display devices need accurate display operations to accurately provide information (e.g. contrasts and chromaticity). In this connection, DICOM represents the standard used to exchange medical information, which was established jointly by ACR (American College of Radiology) and NEMA (National Electrical Manufacture Association).

For example, JESRA (Japan Medical Imaging and Radiological Systems Industries Association) sets guidelines for quality control of medical image display monitors, thus determining standards applicable to medical display devices by use of grayscale standard display functions based on human contrast sensitivities. Thus, medical display devices carry out gamma corrections based on measurements of optical sensors attached to corners of front faces of screens (see Patent Literature Document 1).

CITATION LIST

Patent Literature Document

Patent Literature Document 1: Japanese Patent Application Publication No. H11-69370.

SUMMARY OF INVENTION

Technical Problem

In display devices according to the foregoing conventional arts, optical sensors are attached to corners of screens so that optical sensors will not hinder displayed images on screens. In case of liquid crystal display devices, however, black unevenness or light leakage may occur in corners of screens, equipped with optical sensors, due to influences of temperature or humidity. For this reason, conventional arts suffer from a problem that accurate gamma corrections cannot be performed based on measurements of optical sensors attached to corners of front faces of screens.

The present invention is designed in consideration of the foregoing circumstances; hence, it is an object of the invention to provide a display correction method and a display device which can accurately measure luminance characteristics of displays so as to accurately carry out gamma corrections on displays.

Solution to Problem

To achieve the above object, a display device according to one aspect of the present invention includes a display configured to display images, a storage unit configured to store luminance characteristics at the center of the display, a sensor configured to measure luminance in the periphery of the display, and a signal processing unit configured to correct the measured value of the sensor based on luminance characteristics stored in the storage unit.

To achieve the above object, the present invention is directed to a display correction method used to correct luminance characteristics of a display, including a step of measuring luminance characteristics at the center of the display, a step of measuring luminance in the periphery of the display, a step of correcting the measured value in the periphery of the display, and a step of controlling luminance of the display based on the corrected measurement.

Advantageous Effects of Invention

According to the present invention, it is possible to accurately measure luminance characteristics of the display so as to accurately perform gamma corrections.

DESCRIPTION OF EMBODIMENTS

Hereinafter, one embodiment of the present invention will be described with reference to the drawings.

The present invention is characterized in that a reference sensor is used to perform measurement at the center of a screen; the value measured at the center of the screen is stored; the measured value of an optical sensor attached to a corner of the surface of the screen is corrected using the value measured at the center of the screen; then, a gamma correction is carried out based on the corrected measurement. As a result, it is possible to accurately measure display characteristics, and it is possible to accurately carry out a gamma correction. Thus, it is possible to apply the present invention to medical display devices.

First Embodiment

First, the first embodiment of the present invention will be described.

Figure 1:
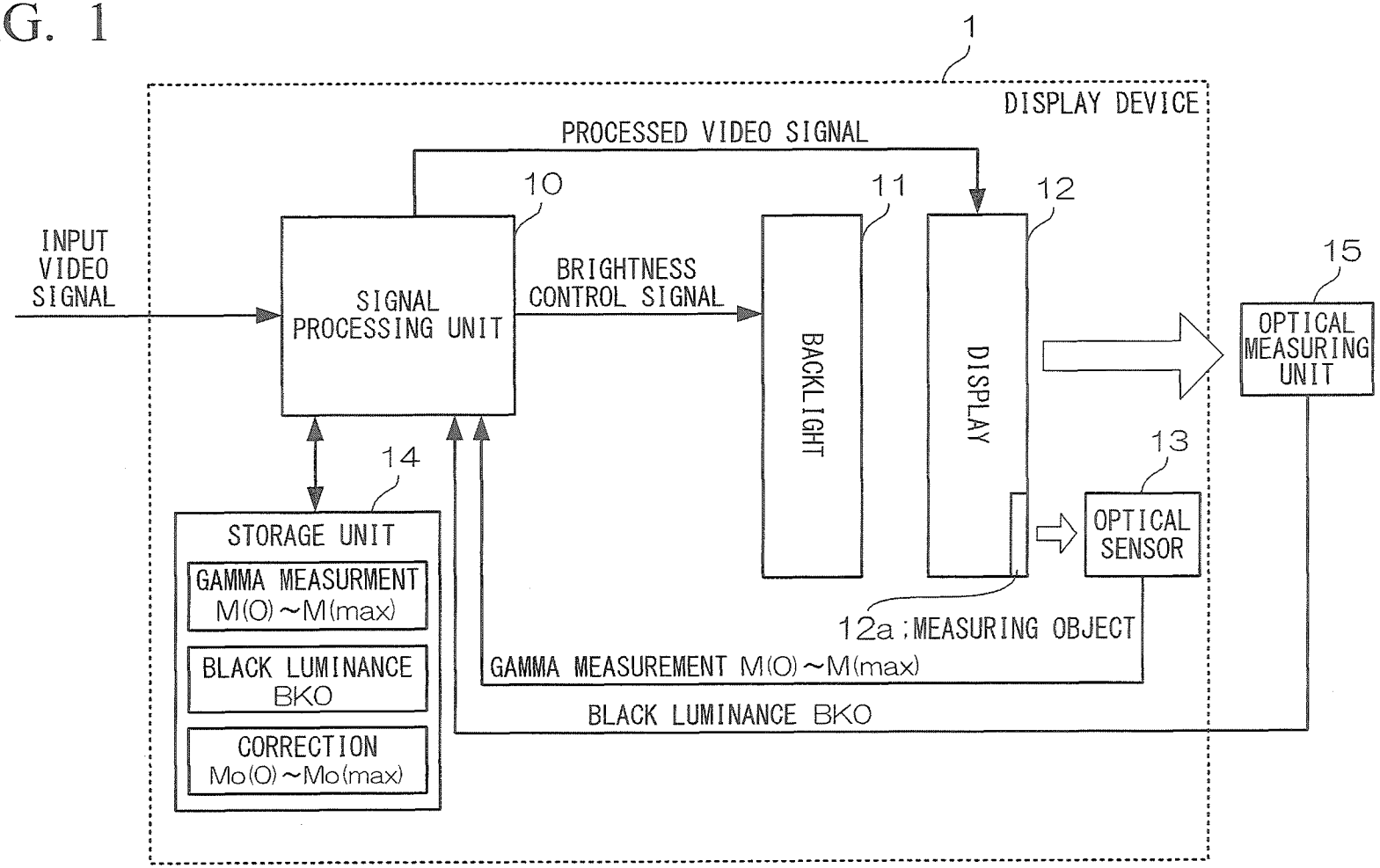
FIG. 1 is a block diagram showing the configuration of a display device 1 according to a first embodiment of the present invention.

FIG. 1 is a block diagram showing the configuration of the display device 1 according to the first embodiment of the present invention. The display device 1 includes a signal processing unit 10, a backlight 11, a display 12, an optical sensor 13, a storage unit 14, and an optical measuring unit 15. The signal processing unit 10 carries out the predetermined signal processing on an input video signal, thus supplying a processed video signal to the display 12. Additionally, the signal processing unit 10 supplies a brightness control signal, based on the processed video signal, to the backlight 11.

For example, the backlight 11, made of a fluorescent tube or an LED, controls light emission so as to realize the predetermined luminance based on the brightness control signal from the signal processing unit 10. For example, the backlight 11 is turned on in the rear face of the display 12.

For example, the display 12, made of a liquid crystal display, displays the processed video signal of the signal processing unit 10 on the screen.

The optical sensor 13, attached to a corner of the surface of the display 12, measures a measuring object 12*a* so as to supply a measured value to the signal processing unit 10.

In a correcting operation, the storage unit 14 stores the measured value of the optical sensor 13 supplied from the signal processing unit 10, and the measured value of the optical measuring unit 15 which will be described later.

In a correcting operation, the optical measuring unit 15 performs measurement on the center of the display 12 so as to supply a measured value to the signal processing unit 10 via the predetermined interface (or the connector). In the normal operation, the optical measuring unit 15 is kept in the predetermined place while being connected with the display device 1. Alternatively, the optical measuring unit 15 having a detachable function is disconnected from the display device 1 and kept in the predetermined place.

According to the above configuration, the display device 1 of the present embodiment includes the display 12 configured to display images, the storage unit 14 configured to store luminance characteristics at the center of the display, the sensor (i.e. the optical sensor 13) configured to measure luminance in the periphery of the display, and the signal processing unit 10 configured to correct the measured value of the sensor.

Additionally, the signal processing unit 10 corrects the measured value of the sensor (i.e. the optical sensor 13) based on a difference between black luminance stored in the storage unit 14 and a measured value corresponding to black luminance among measured values measured with the sensor while the luminance of the display 12 is being changed from black luminance to white luminance.

Specifically, the signal processing unit 10 controls the display 12 to change displayed colors from black to white in a correcting operation. At this time, the optical sensor 13 measures variations of colors being changed from black to white in the measuring object 12*a* at a corner of the screen of the display 12, thus supplying measured values M(0) to M(max) to the signal processing unit 10. Additionally, the optical measuring unit 15 measures black luminance BK0 at the center of the display 12 so as to supply black luminance BK0 to the signal processing unit 10. The storage unit 14 stores the measured values M(0) to M(max) measured with the optical sensor 13, and the black luminance BK0 measured with the optical measuring unit 15.

By using the measured value of black M(0), the measured value of white M(max), and intermediate values M(1), . . . , M(max−1), the signal processing unit 10 produces the corrected values Mo(0) to Mo(max) which are calculated by correcting the measured values M(0) to M(max) by use of the black luminance BK0 in a correcting operation. In a correcting operation, both the optical sensor 13 and the optical measuring unit 15 may perform measurement periodically, with the predetermined interval of time (or an interval of time based on an operating time), or at arbitrary timing.

In a normal operation after correction, the signal processing unit 10 corrects the measured values M(0) to M(max), measured with the optical sensor 13 attached to a corner of the surface of the display 12, by use of the corrected values Mo(0) to Mo(max) so as to control the processed video signal supplied to the display 12, thus performing a gamma correction.

The reason why the luminance measured with the optical sensor 13 in the periphery of the display 12 can be corrected using luminance characteristics measured with the optical measuring unit 15 at the center of the display 12 will be described below.

In general, display devices may occasionally undergo unevenness in the entirety of screens. In particular, liquid crystal displays may suffer from light leakage and black unevenness occurring at the edges of screens. Due to light leakage, light may be leaked from a gap between a glass and a metal plate holding a glass. This is because signals from driver ICs used to control liquid crystal elements are transmitted using non-display areas, wherein, irrespective of masking used to prevent a backlight from leaking light via non-display areas, light may be leaked from any gaps formed in masking. Black unevenness may occur when a glass is twisted or changed in terms of transmissivity due to a varying pressure of a metal plate holding a glass or when a glass is changed in terms of transmissivity due to expansion or contraction of a glass. It is possible to assume that these factors may be changed depending on temperature, humidity, or external forces.

Since these factors could be mostly connected to the edges of screens, it is possible to assume that the luminance at the center of the display 12 may not be substantially shifted from the measured value of the optical measuring unit 15. For this reason, the present invention employs the optical measuring unit 15 which corrects the luminance measured with the optical sensor 13 in the periphery of the display 12 by use of luminance characteristics measured with the optical measuring unit 15 at the center of the display 12.

Next, the operation of the first embodiment will be described.

Figure 2:
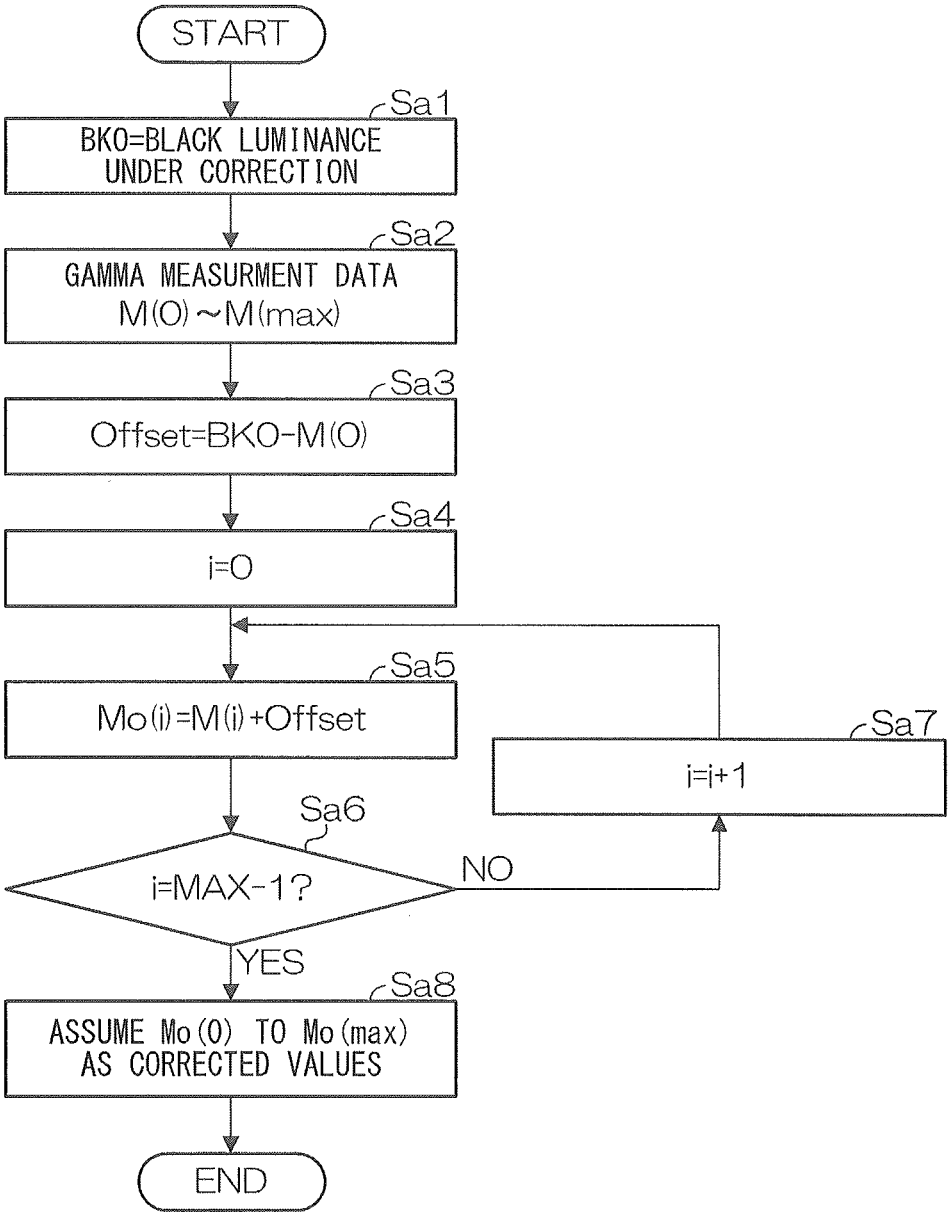
FIG. 2 is a flowchart used to explain the operation of the first embodiment (i.e. a correcting operation).

FIG. 2 is a flowchart used to explain the operation of the first embodiment (i.e. a correcting operation). The flowchart of FIG. 2 is executed after the measurement of the optical sensor 13 and the optical measuring unit 15. At the timing of executing the flowchart shown in FIG. 2, the storage unit 14 has stored the measured values M(0) to M(max) of the optical sensor 13, and the black luminance BK0 representing the measured value of the optical measuring unit 15 which will be described later.

(Step Sa1)

First, the signal processing unit 10 reads the black luminance BK0, measured with the optical measuring unit 15 at the center of the screen, from the storage unit 14.

(Step Sa2)

Next, the signal processing unit 10 reads the measured values M(0) to M(max), measured with the optical sensor 13, from the storage unit 14.

(Step Sa3)

Next, the signal processing unit 10 produces an influential factor "BK0-M(0)" as Offset since the black luminance BK0 subjected to correction indicates a correct value of luminance while the currently measured luminance M(0) indicates changed luminance due to black unevenness. That is, Offset indicates an error or a deviation of the luminance M(0) of the measuring object 12*a* at a corner of the screen in comparison with the black luminance BK0 at the center of the screen. In other words, it is necessary to correct M(1) to M(max−1) by use of Offset since M(0)+Offset=BK0.

(Step Sa4)

Next, the signal processing unit 10 puts 0 into variable i.

(Step Sa5)

Next, the signal processing unit 10 calculates Mo(i)=M(i)+Offset.

(Step Sa6)

Next, the signal processing unit 10 determines whether or not variable i becomes i=MAX (maximum). The signal processing unit 10 proceeds to step Sa8 when variable i becomes i=MAX (maximum) (i.e. YES of step Sa6), while the signal processing unit 10 proceeds to step Sa7 when variable i does not become i=MAX (i.e. NO of step Sa6).

(Step Sa7)

Upon not determining i=MAX, the signal processing unit 10 increments variable i by 1 and then reverts to step Sa5. Thereafter, the signal processing unit 10 calculates Mo(i)=M(i)+Offset in step Sa5 while incrementing variable i until variable i reaches MAX, thus correcting M(1) to M(max−1) by use of Offset.

(Step Sa8)

Upon determining i=MAX, the signal processing unit 10 has already calculated Mo(0) to Mo(max), which are assumed as corrected values of luminance Mo(0) to Mo(max).

After correction, it is possible to predict the measured value of the optical measuring unit 15 based on the measured value of the optical sensor 13 by way of comparison between the measured value of the optical sensor 13 and the measured value of the optical measuring unit 15 stored in the storage unit 14. That is, in the normal operation, the display device 1 corrects the measured value of the optical sensor 13 by use of the corrected values of luminance Mo(0) to Mo(max) so as to control the processed video signal of the display 12 based on the corrected measurements, thus accurately performing a gamma correction. For example, it is possible to realize display devices suited to medical applications.

In a correcting operation in which white luminance appears but differs from white luminance which was corrected by adjusting the backlight 11, it is necessary to store screen luminance information such as a backlight control value subjected to correction in addition to black luminance BK0 stored in the storage unit 14, and therefore it is possible to calculate a ratio of this value to the screen luminance information such as a current backlight control value so as to predict the current black luminance at the center of the screen based on the stored black luminance BK0 and the ratio, thus replacing the predicted value of black luminance with the black luminance BK0.

Specifically, the ratio is calculated using the current backlight control value and the backlight control value subjected to correction. For example, the backlight control value subjected to correction is set to "70"; the current backlight control value is set to "90"; and the black luminance at the center of a screen subjected to correction is set to "1.2". Thus, it is possible to produce the current black luminance equal to 1.2×90/70. That is, the screen luminance of a liquid crystal display is calculated as the brightness of the backlight 11 multiplied by transmissivity. The above method can be used to calculate the screen luminance since the transimissivity related to black luminance is not changed due to the linear relationship between the backlight control value and the brightness. In this connection, experiments roughly show the linear relationship between the backlight control value and the brightness.

Next, the effect of the first embodiment will be described.

Figure 3:
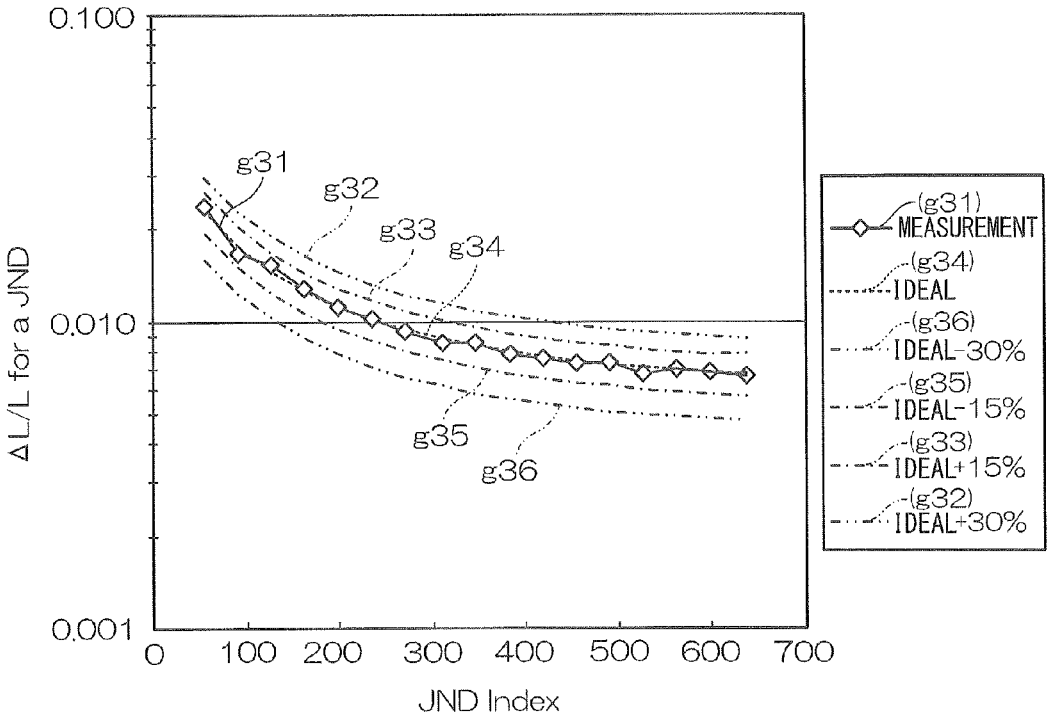
FIG. 3 is a graph used to explain GSDF curves subjected to correction.
Figure 4:
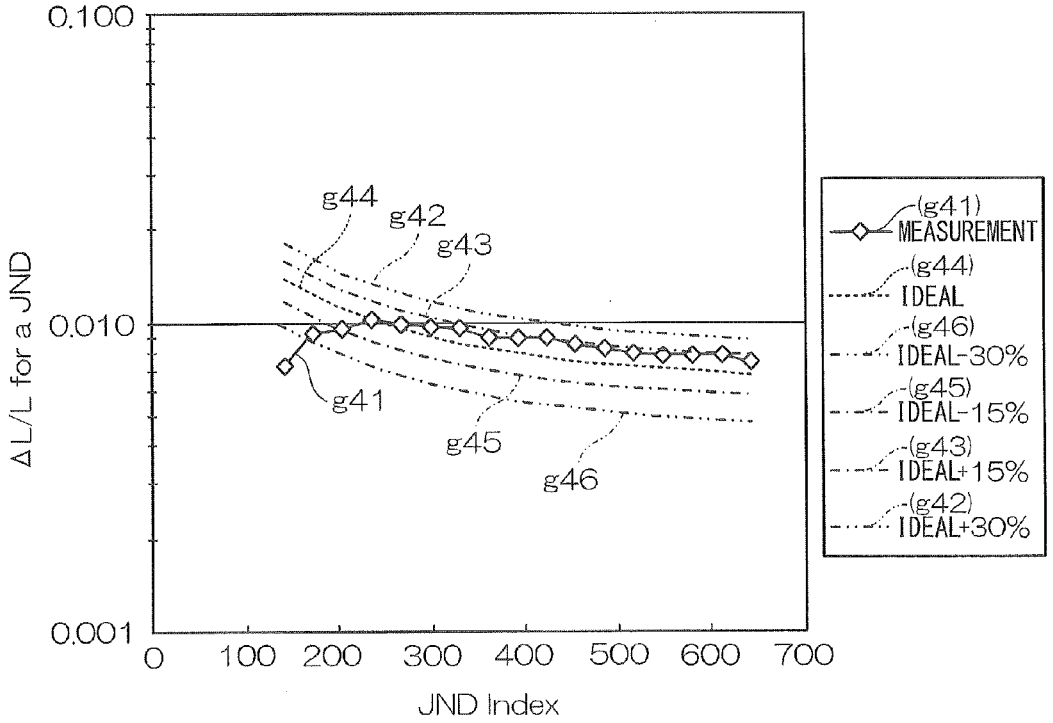
FIG. 4 is a graph used to explain GSDF curves with variations of screen unevenness characteristics due to variations of light leakage.
Figure 5:
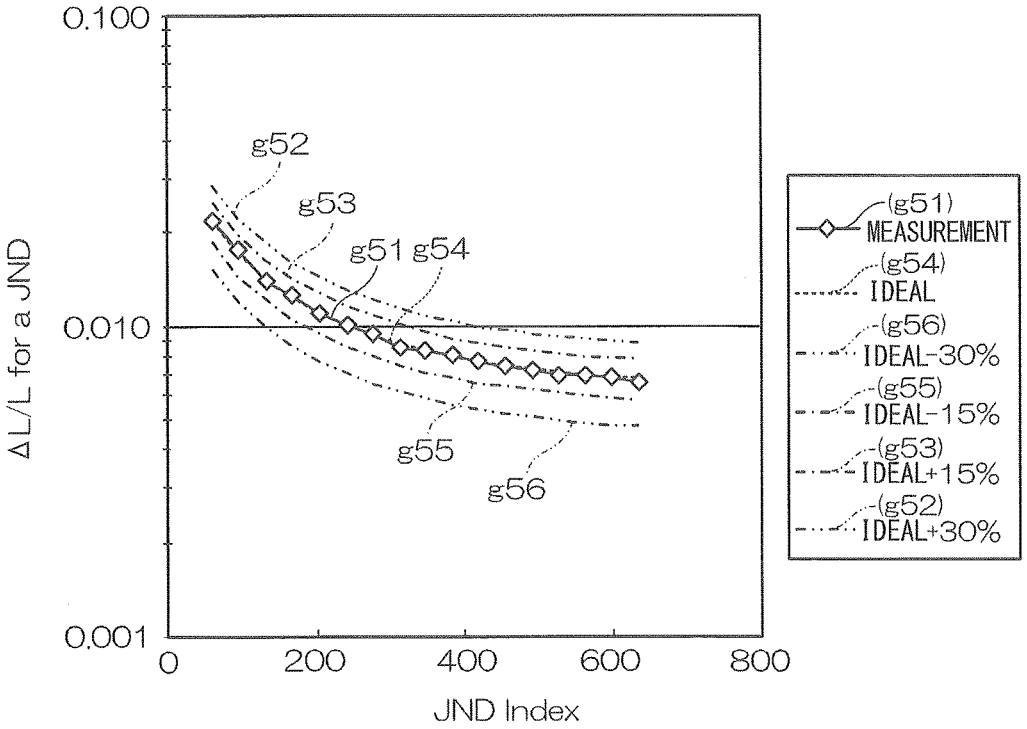
FIG. 5 is a graph used to explain GSDF curves according to the correction method of the first embodiment.

FIG. 3 is a graph used to explain GSDF (Grayscale Standard Display Function) after correction. FIG. 4 is a graph used to explain GSDF curves reflecting variations of screen unevenness characteristics due to variations of light leakage. FIG. 5 is a graph used to explain GSDF curves according to the correction method of the first embodiment. In FIGS. 3 to 5, the horizontal axis represents the scale of JND Index in which one-step difference of JND Index corresponds to the minimum difference of luminance recognizable by humans. The vertical axis represents (ΔL/L). Herein, L represents luminance. In this connection, GSDF curves represent grayscale standard display function curves defined by the DICOM standard, Chapter 14 (DICOM3.0 Part 14).

In FIG. 3, Curve g31 represents a GSDF curve after correction. In FIG. 4, Curve g41 represents a GSDF curve after variations of screen unevenness characteristics. In FIG. 5, Curve g51 represents a GSDF curve which is obtained by applying the correction of the present embodiment to FIG. 4.

In FIGS. 3 to 5, Curves g32, g42, g52 show +30 [% (percent)] above the standard values (or the ideal values), while Curves g33, g43, g53 show +15 [%] above the standard values. Curves g34, g44, g54 show the standard values. Additionally, Curves g35, g45, g55 show −15 [%] below the standard values, while Curves g36, g46, g56 show −30 [%] below the standard values.

As shown in FIG. 3, the contrast response subjected to correction falls within ±15 [%] above/below the standard value of the contrast response in management grade-1 (hereinafter, referred to as the contrast-response standard value). Due to variations of screen unevenness characteristics due to variations of light leakage, the contrast response is significantly deviated from the standard value as shown in FIG. 4. According to the correction method of the first embodiment, the contrast response is corrected to fall within ±15 [%] above/below the standard value of the contrast response as shown in FIG. 5.

Management grade-1 for medical monitors is determined in accordance with "Guidelines for Quality Control of Medical Image Display Monitors" (Incorporated Association, Japan Medical Imaging and Radiological Systems Industries Association, JESRA X-0093$^{-2005}$). Specifically, it defines the maximum luminance of 170 [cd/m2] or more, the luminance ratio of 250 or more, and the contrast response within ±15 [%].

According to the first embodiment, it is possible to accurately measure luminance characteristics of displays, and it is possible to accurately carry out gamma corrections. In particular, it is possible to provide display devices suited to medical applications.

Second Embodiment

Next, the second embodiment of the present invention will be described.

Figure 6:
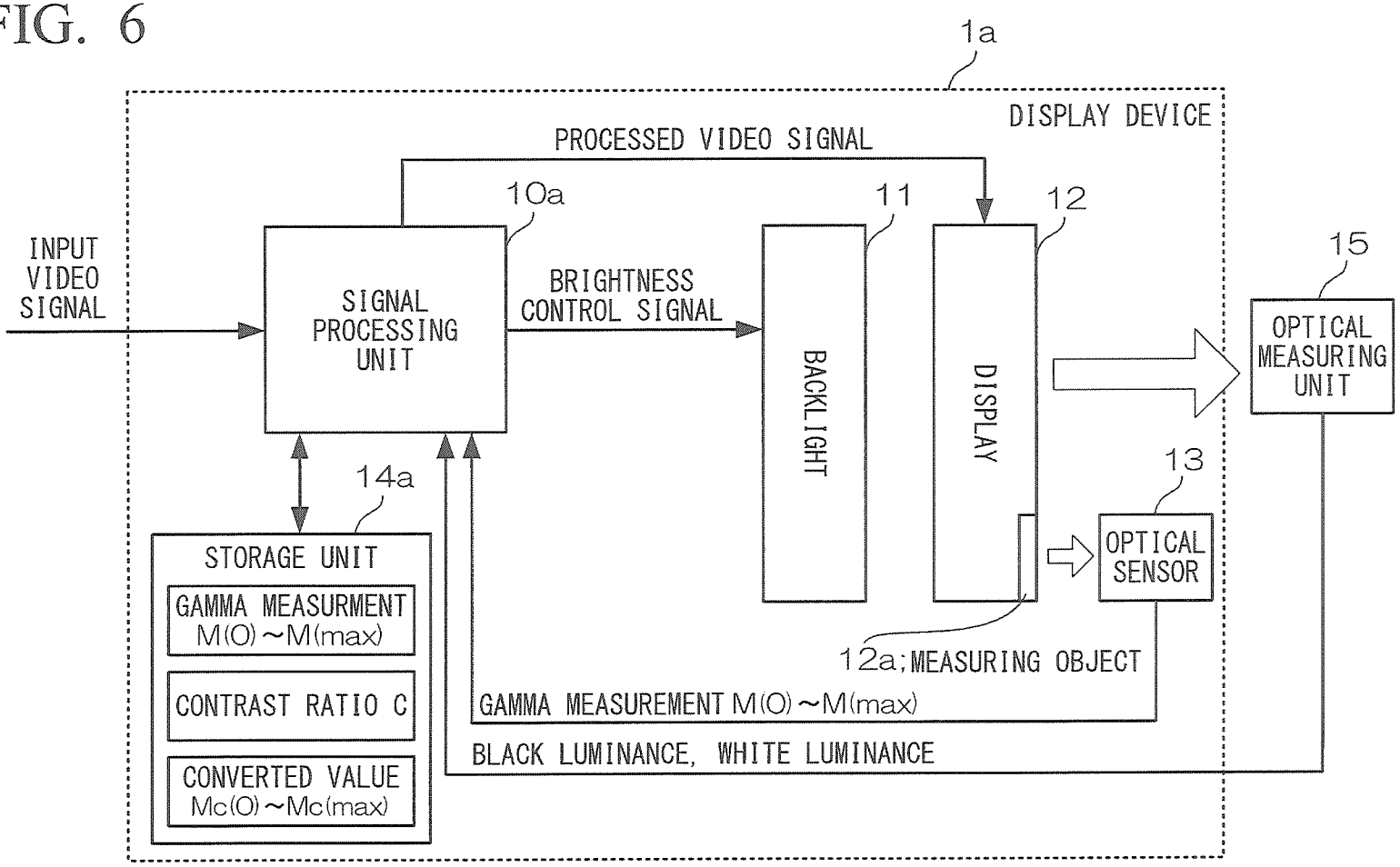
FIG. 6 is a block diagram showing the configuration of a display device 1 according to a second embodiment of the present invention.

FIG. 6 is a block diagram showing the configuration of a display device 1*a* according to the second embodiment of the present invention. In FIG. 6, parts identical to those shown in FIG. 1 are denoted using the same reference signs; hence, descriptions thereof will be omitted. In the second embodiment similar to the first embodiment, a signal processing unit 10*a* controls the processed video signal supplied to the display 12 so as to change displayed colors from black to white in a correcting operation. At this time, the optical sensor 13 measures variations of color being changed from black to white in the measuring object 12*a* at a corner of the screen of the display 12, thus supplying the measured values M(0) to M(max) to the signal processing unit 10*a*. The optical measuring unit 15 measures variations of color being changed from black to white at the center of the display 12, thus supplying black luminance and white luminance to the signal processing unit 10*a*. A contrast ratio C is calculated based on white luminance and black luminance measured with the optical measuring unit 15. The storage unit 14 stores the values of luminance M(0) to M(max) measured with the optical sensor 13, and the contrast ratio C measured with the optical measuring unit 15. In this connection, the contrast ratio represents Lmax (luminance of the screen displaying white)/Lmin (luminance of the screen displaying black).

In a correcting operation, the signal processing unit 15 produces white luminance We and black luminance BKc from the measured values M(0) to M(max) of the optical sensor 13 based on the contrast ratio C produced from the measured value of the optical measuring unit 15. Using M(0) and M(max) among the measured values M(0) to M(max), the ratio of measured values M(i) can be determined as "(M(1)−M(0)/M(max)−M(0))". Based on the above ratio, it is possible to determine Mc(i) after correction as Mc(i)=(M(i)−M(0)/M(max)−M(0))×(Wc−BKc)+BKc.

As described above, the signal processing unit 10*a* calculates the corrected measurements Mc(0) to Mc(max), which are produced by correcting the measured values M(0) to M(max) of the optical sensor 13, based on the contrast ratio C produced from the measured value of the optical measuring unit 15, thus storing them in a storage unit 14*a*.

In the normal operation after correction, the signal processing unit 10*a* corrects the measured values of the optical sensor 13 into the corrected measurements, i.e. the corrected measured values Mc(0) to Mc(max), so as to control the processed video signal supplied to the display 12, thus carrying out gamma corrections.

Next, the operation of the second embodiment will be described.

Figure 7:
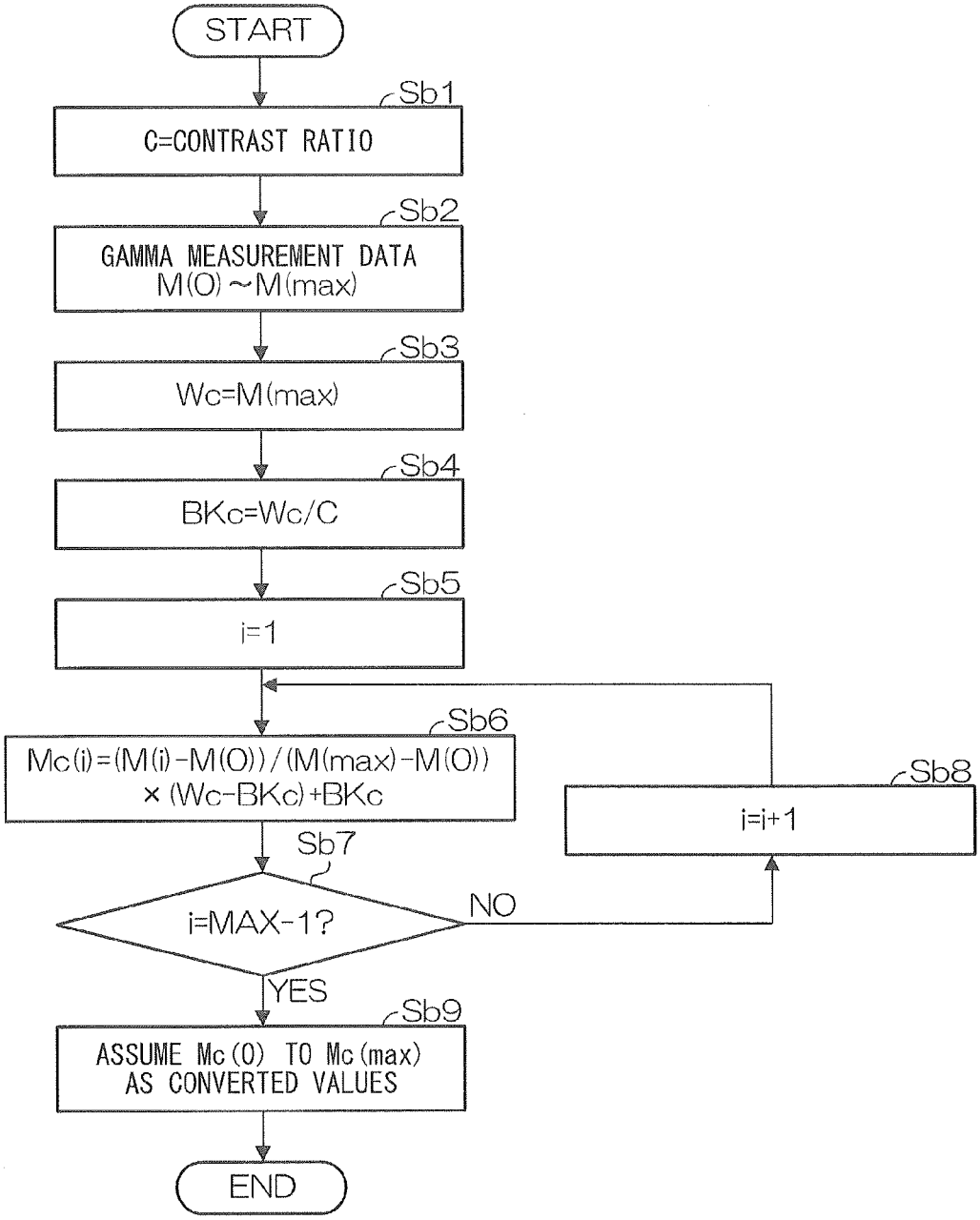
FIG. 7 is a flowchart used to explain the operation of the second embodiment (i.e. a correcting operation).

FIG. 7 is a flowchart used to explain the operation of the second embodiment (i.e. a correcting operation). The flowchart of FIG. 7 is executed after the measurement of the optical sensor 13 and the optical measuring unit 15. At the time of executing the flowchart of FIG. 7, it is assumed that the storage unit 14 has stored the measured values M(0) to M(max) of the optical sensor 13, and the contrast ratio C which is produced from the measured value of the optical measuring unit 15 which will be described later.

(Step Sb1)

First, the signal processing unit 10*a* reads the contrast ratio C, which is calculated based on the measured value (black luminance, white luminance) of the optical measuring unit 15, from the storage unit 14*a*.

(Step Sb2)

Next, the signal processing unit 10*a* reads the measured values M(0) to M(max) of the optical sensor 13 from the storage unit 14*a*.

(Step Sb3)

Next, the signal processing unit 10*a* assumes the measured value M(max), representing the maximum luminance, as white luminance Wc.

(Step Sb4)

Next, the signal processing unit 10*a* calculates black luminance BKc based on the contrast ratio C and the while luminance Wc.

(Step Sb5)

Next, the signal processing unit 10*a* puts 1 to variable i.

(Step Sb6)

Next, the signal processing unit 10*a* calculates $$Mc(i)=(M(i)-M(0)/M(\max)-M(0))\times(Wc-BKc)+BKc.$$

(Step Sb7)

Next, the signal processing unit 10*a* determines whether or not variable i becomes i=MAX−1. The signal processing unit 10*a* proceeds to step Sb9 when variable i becomes i=MAX−1 (i.e. YES of step Sb7), while the signal processing unit 10*a* proceeds to step Sa8 when variable i does not become i=MAX−1.

(Step Sb8)

Upon determining that variable i does not become i=MAX−1, the signal processing unit 10*a* increments variable i by 1 and then reverts to step Sb6.

Thereafter, the signal processing unit 10*a* calculates Mc(i)=(M(i)−M(0)/M(max)−M(0))×(Wc−BKc)+BKc in step Sb6 while incrementing variable i until variable i becomes i=MAX−1, thus correcting M(1) to M(max−1) based on the contrast ratio C.

(Step Sb9)

Upon determining that variable i becomes i=MAX−1, the signal processing unit 10*a* calculates Mc(0) to Mc(max), which are thus assumed as the corrected measured values Mc(0) to Mc(max). Herein, Mc(0)=BKc, Mc(max)=Wc.

In the normal operation, the display device 1*a* corrects the measured values of the optical sensor 13 into the corrected measured values Mc(0) to Mc(max) so as to control the processed video signal supplied to the display 12 based on the corrected measurements, and therefore it is possible to accurately perform gamma corrections. This makes it possible, for example, to realize display devices suited to medical applications.

Although the foregoing embodiment is designed to store contract values in the storage unit 14*a*, it is possible to separately store white luminance and black luminance so as to read them and calculate white luminance/black luminance.

Figure 8:
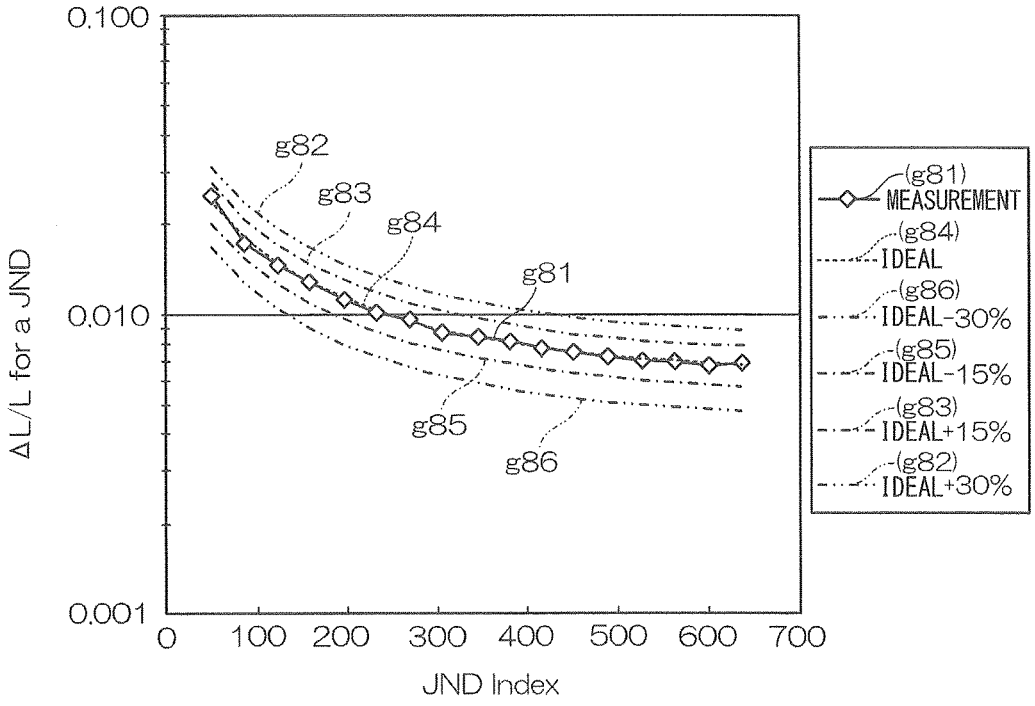
FIG. 8 is a graph used to explain GSDF curves according to the correction method of the second embodiment.

FIG. 8 is a graph used to explain GSDF curves according to the correction method of the second embodiment. In FIG. 8, the horizontal axis represents the scale of JND Index. The vertical axis represents (ΔL/L). In FIG. 8, for example, Curve g81 represents a GSDF curve which is produced by performing the correction of the present embodiment on FIG. 4. In FIG. 8, Curve g82 shows +30 [% (percent)] above the standard value (or the ideal value), while Curve g83 shows +15 [%] above the standard value. Curve g84 shows the standard value. Curve g85 shows −15 [%] below the standard value, while Curve g86 shows −30 [%] below the standard value.

As shown in FIG. 8, it is possible for curves to fall within ±15 [%] above/below the standard value of the contrast response by way of the correction of the second embodiment using the contrast ratio.

According to the second embodiment, it is possible to accurately measure luminance characteristics of displays, and it is possible to accurately perform gamma corrections on displays. Additionally, it is possible to accurately measure black or halftone gammas.

The second embodiment differs from the first embodiment in that it uses contrast values, wherein the contrast ratio of the display 12 is unchanged even though white luminance determined by adjusting the backlight 11 differs from white luminance determined via a correcting operation; hence, it is possible to use different values of white luminance in the foregoing calculation.

In the first and second embodiments, the optical measuring unit 15 serves as a constitutional element of the display device 1 (including 1*a*); but this is not a restriction. The optical measuring unit 15 may serve as an independent device disposed separately of the display device 1 (including 1*a*). Additionally, the optical measuring unit 15 may be configured to transmit measured values wirelessly or by radio to the display device 1 (including 1*a*) via the predetermined interface or the personal computer. Moreover, the display device 1 (including 1*a*) may store the received measured values in the storage unit 14 (including 14*a*).

When the first and second embodiments are significantly influenced by light leakage so that corrected measured values cannot be confined within standard values, the signal processing unit 10 (including 10*a*) displays a message, indicating that corrected measured values cannot be confined within standard values, on the display 12, thus notifying the message to user. For example, the signal processing unit 10 (including 10*a*) may notify events in which corrected measured values cannot be confined within ±15 [%] above/below the standard value of the contrast response according to management grade-1 or within ±30 [%] above/below the standard value of the contrast response according to management grade-2.

Both the first and second embodiments may use the backlight 11 serving as one of light sources of red, blue, and green. In this case, the signal processing unit 10 (including 10*a*) may calculate corrected values, used for controlling, applied to the backlight 11 emitting one of red, blue, and green light. In this case, the optical sensor 13, attached to the front face of the display 12, may be equipped with a color filter suited to the backlight 11 emitting one of red, blue, and green light, whereby it is possible to acquire a sensor value isolated via the color filter so as to perform a correcting operation when performing gamma measurement on color being changed from black to white.

The first and second embodiments show examples of liquid crystal displays having backlights; but this is not a restriction. It is possible to apply the present embodiment to a display device in which an optical sensor is not attached to the center of a display. In this case, it is possible for the present embodiment to measure luminance characteristics of displays so as to perform gamma corrections on displays. Additionally, it is possible for the present embodiment to accurately measure black and halftone gammas.

In the foregoing embodiments, it is possible to store programs, implementing the function of the signal processing unit 10 of FIG. 1 or the function of the signal processing unit 10*a* of FIG. 6 in computer-readable storage media, whereby programs stored in storage media can be loaded to computer systems and executed to implement the processing of various parts. Herein, the "computer system" may embrace OS and hardware such as peripheral devices.

The term "computer system" using the WWW system may embrace homepage providing environments (or homepage displaying environments).

The term "computer-readable storage media" may refer to flexible disks, magneto-optical disks, ROM (Read-Only Memory), portable media such as CD-ROM, UBS memory connected via USB (Universal Serial Bus) I/F (interface), and storage devices such as hard disks installed in computer systems. Additionally, the term "computer-readable storage media" may embrace any measures storing programs for a certain time such as volatile memory included in computer systems serving as servers and clients. Moreover, the foregoing programs may achieve part of the foregoing functions. Alternatively, the foregoing programs may be combined with other programs pre-installed in computer systems so as to achieve the foregoing functions.

REFERENCE SIGNS LIST

1, 1*a* . . . display device; 10, 10*a* . . . signal processing unit; 11 . . . backlight; 12 . . . display; 12*a* . . . measuring object; 13 . . . optical sensor; 14, 14*a* . . . storage unit; 15 . . . optical measuring unit

The invention claimed is:

1. A display device comprising:

a display which is configured to display an image;

a storage unit which is configured to store a contrast ratio at a center of the display;

a sensor which is attached to a periphery of the display so as to measure luminance in the periphery of the display by changing the luminance of the display from black luminance to white luminance, thus producing a plurality of measure values; and a signal processing unit is configured to correct the plurality of measured values based on the contrast ratio so as to calculate a plurality of corrected measured values, wherein the plurality of corrected measured values are calculated based on the plurality of measured values and a predetermined black luminance which is a maximum value, among the plurality of measured values, divided by the contrast ratio.

2. The display device according to claim 1, wherein the signal processing unit controls the luminance of the display based on the plurality of corrected measured values.

3. The display device according to claim 1, wherein the signal processing unit controls a video signal of the display based on the plurality of corrected measured values.

4. The display device according to claim 1, further comprising a backlight which is turned on in a rear face of the display, wherein the signal processing unit controls a video signal of the display based on the plurality of corrected measured values.

5. The display device according to claim 1, further comprising an optical measuring unit which is configured to measure black luminance and white luminance at the center of the display, wherein the signal processing unit calculates the contrast ratio based on black luminance and white luminance measured with the optical measuring unit.

6. A luminance measurement correcting method for a display, comprising:

measuring a contrast ratio at a center of the display;

measuring luminance in a periphery of the display so as to produce a plurality of measured values by changing the luminance of the display from black luminance to white luminance;

correcting the plurality of measured values based on the contrast ratio, thus calculating a plurality of corrected measured values; and controlling the luminance of the display based on the plurality of corrected measured values, wherein the plurality of corrected measured values are calculated based on the plurality of measured values and a predetermined black luminance which is a maximum value, among the plurality of measured values, divided by the contrast ratio.

7. The display device according to claim 1, wherein the signal processing unit controls the display to change displayed colors from black to white when the signal processing unit corrects the measured values.

8. A device comprising:

a display which is configured to display an image;

a storage unit which is configured to store a contrast ratio at a center of display;

a sensor which is attached to a periphery of the display so as to measure luminance in the periphery of the display by changing luminance of the display from black luminance to white luminance, this producing a plurality of measure values; and a signal processing unit which is configured to correct the plurality of measured values based on the contrast ratio so as to calculate a plurality of corrected measured values, wherein, using M(0) to M(max) representing the plurality of measured values, and C representing the contrast ratio, Mc(i) representing the corrected measured value for each measured value M(i) (where i=0 to max) is calculated by $$Mc(i)=(M(i)-M(0))/(M(\max)-M(0))\times(Wc-BKc)+BKc$$

where Wc=M(max) and BKc=Wc/C.

9. The display device according to claim 1, wherein the sensor is attached to a corner of the display as the periphery of the display.

* * * * *